United States Patent [19]

Schupp

[11] 3,969,067

[45] July 13, 1976

[54] PHOTOFLASH LAMP

[75] Inventor: Lewis J. Schupp, Chesterland, Ohio

[73] Assignee: General Electric Company, Schenectady, N.Y.

[22] Filed: Mar. 12, 1975

[21] Appl. No.: 557,624

[52] U.S. Cl. ..... 431/95 R; 149/37; 149/19.91

[51] Int. Cl.[2] ..... F21K 5/02

[58] Field of Search ..... 149/37, 19.91, 40, 41; 431/93–95

[56] References Cited

UNITED STATES PATENTS

| | | | |
|---|---|---|---|
| 2,791,111 | 5/1957 | Gleim | 431/95 |
| 2,982,119 | 5/1961 | Anderson | 431/95 |
| 3,111,016 | 11/1963 | Fink et al. | 431/95 |
| 3,501,254 | 3/1970 | Nijland et al. | 431/95 |
| 3,540,820 | 11/1970 | Shaffer et al. | 431/93 |
| 3,556,699 | 1/1971 | Takahashi et al. | 431/95 |
| 3,602,619 | 8/1971 | Van Der Tas et al. | 431/95 |
| 3,627,459 | 12/1971 | Van Der Tas et al. | 431/95 |
| 3,724,991 | 4/1973 | Schupp | 431/95 |
| 3,823,994 | 7/1974 | De Graaf et al. | 431/95 |
| 3,893,798 | 7/1975 | Sterling | 431/95 |

*Primary Examiner*—Carroll B. Dority, Jr.
*Attorney, Agent, or Firm*—John F. McDevitt; Lawrence R. Kempton; Frank L. Neuhauser

[57] ABSTRACT

An improved primer material is disclosed for a high-voltage type flashlamp construction. Said primer material comprises a solid mixture of a combustible fuel and an oxidizer for the fuel such as alkali metal chlorates and perchlorates, and which further contains a combustion-supporting oxide of the type which is converted to a lower oxide upon combustion of the mixture. A still further alumina gel additive in said primer composition modifies the ignition characteristics in a desirable manner for use in a high-voltage type flashlamp. An all-glass flashlamp construction is disclosed in which the improved primer material can be disposed between a pair of spaced-apart inlead wires to provide the desired ignition of a quantity of filamentary combustible material distributed within the lamp envelope.

14 Claims, 1 Drawing Figure

PHOTOFLASH LAMP

CROSS-REFERENCE TO RELATED APPLICATIONS

The present invention represents an improvement to the primer material composition and flashlamp construction disclosed and claimed in my prior copending U.S. patent application, Ser. No. 508,107, filed Sept. 23, 1974, entitled "Photoflash Lamp" and assigned to the assignee of the present invention.

BACKGROUND OF THE INVENTION

This invention is in the field of photoflash lamps of the so-called high-voltage type, which contain a primer material connected across inlead wires, there being no conventional filament in such a lamp. These lamps further contain a hermetically sealed light-transmitting envelope made of glass at the present time along with a combustion-supporting gas such as oxygen together with a loosely distributed filling of a suitable light-producing combustible material such as shredded foil of zirconium, aluminum or hafnium, for example, which upon ignition produces a high intensity flash of actinic light.

Electrically actuated photoflash lamps may be classified generally into two voltage types: low-voltage and high-voltage. The low-voltage types usually are intended to be flashed by a battery, or a charged capacitor, having a voltage of about 1.5 volts to 15 volts, whereas the high-voltage flashlamps are intended to be flashed by a firing pulse of a few hundred volts or greater such as can be produced by striking a piezoelectric material. Conventional low-voltage flashlamps contain a filament connected across inlead wires. When the filament is heated by a firing current, it ignites a primer material which in turn ignites a combustible material such as metal foil which, with the aid of oxygen in the lamp, produces a flash of light. In typical high-voltage flashlamp constructions, the primer material is connected directly across and between a pair of inlead wires extending into the lamp envelope. The primer material may be positioned and carried in the lamp on top of a glass or ceramic insulating member through which the inlead wires extend, or may be carried in a cavity provided in such member. In a different construction, the primer material is carried on or in a depression in the inner wall of the envelope at the bottom of the lamp. In still a different high-voltage flashlamp construction, disclosed in U.S. Pat. Nos. 2,868,003 and 3,000,200, both to Warren Albrecht, the primer material is applied to one or both of the inlead wires within the lamp and the electrical circuit is completed through the combustible shredded metal foil in the lamp.

Various primer materials suitable for the ignition means in the above type lamp constructions are known. The known primer materials generally consist of a solid mixture of a readily combustible fuel such as phosphorous or combustible incandescible metal with an oxidizer compound for the fuel such as alkali metal and alkaline earth metal chlorates as well as perchlorates, including sodium perchlorate, potassium perchlorate, barium chlorate, sodium chlorate, and potassium chlorate. The fuel in the primer material is generally a powdered incandescible metal such as zirconium, hafnium, thorium, aluminum, magnesium, boron, silicon or other alloys which upon actuation by a high-voltage pulse ignites the filamentary combustible material. The known primer materials are generally prepared as a liquid suspension in an organic or aqueous solvent to provide an adherent mass of the primer material between the spaced apart inleads. A known organic liquid suspension for the primer material that is described in U.S. Pat. No. 2,972,937 to C. G. Suits utilizes nitrocellulose as the binder agent and it requires careful handling during storage and lamp manufacture to avoid accidental ignition. A less sensitive aqueous suspension of the primer material utilizing the conventional ignition mixture employs hydroxyethylcellulose or methylcellulose, polyvinyl alcohol, or polyvinyl pyrrolidone as water-soluble binder agents.

A number of important considerations for the primer material to reliably ignite the combustible material in a high-voltage flashlamp of the type above generally described are pointed out in my aforementioned copending patent application. An important operating characteristic of the primer material is the voltage at which the primer's electrical resistance breaks down and decreases thus allowing sufficient electrical energy to be transferred from the firing pulse at its available voltage level to cause primer ignition. Excessive variation in this breakdown voltage characteristic could lead to a failure of the lamp to flash or to flash with an inferior light output. As regards this operating characteristic, it is also desirable for the initial breakdown voltage level to be sufficiently high so that the primer material is not overly sensitive to accidental ignition from electrostatic charges which can build up during ordinary handling of the flashlamps. On the other hand, the breakdown voltage level in the primer material should not be raised in a manner which also impairs reliable ignition when the firing pulse is applied across the spaced-apart inleads.

SUMMARY OF THE INVENTION

It has now been discovered, surprisingly, that the operation of the primer material in a high-voltage flashlamp construction can be modified to promote less sensitivity to premature accidental ignition from ambient electrostatic charges without requiring an increase in the maximum energy provided by the firing pulse. More specifically, it has been found that a small but effective amount of an alumina gel material can be added to the primer material composition disclosed in the above mentioned copending patent application to impart this improvement in the primer operation. The primer material incorporating said additive comprises a solid mixture of a combustible fuel, an oxidizer for said combustible fuel, and a combustion-supporting oxide which is converted to a lower oxide upon combustion of the mixture. In said primer mixture, the combustion-supporting oxide can be present in sufficient amounts to lower the electrical conductivity of the primer residue. Such primer compositions are useful for high-voltage lamp constructions intended for use in a multilamp photoflash array wherein the individual lamps provide an "open circuit" to successive high-voltage pulses after flashing. When such combustion-supporting oxides are present in amounts up to 50 weight percent or greater of said primer mixture, the flashlamp construction is of the open circuit type and it is essential to select the combustion-supporting oxide from materials which do not readily convert to a conductive state such as a lower conductive oxide or metallic state in the post ignition primer residue. Useful combustion-supporting oxides for the preferred primer material compositions of the present invention are selectable from the group consisting of $Co_3O_4$, $BaCrO_4$, $Fe_2O_3$, and higher oxides of nickel by reason of not converting to form a conductive residue when the primer is ignited. In contrast thereto, other metal oxides which are reduceable by the fuel constituent in the primer mixture upon ignition include CuO, PbO, $SnO_2$, $TiO_2$, and ZnO which form conductive residues, hence are unsatisfactory for use in an open circuit flashlamp design.

Useful alumina gel additives for the improved primer material compositions of the present invention comprise a very finely divided form of aluminum hydroxide which contains some alumina and is commercially available. A preferred alumina gel material of this type is marketed by the Chattem Chemical Company as Alumina Hydroxide Gel AHLT-LW. In a preferred embodiment, the improved primer material is applied as an aqueous dispersion which is subsequently dried during lamp manufacture to provide a mass of adhesively bonded material across the inleads. The alumina gel additive in said primer material composition can also be a hydrolizable aluminum alkoxide compound which is converted in the aqueous dispersion to a finely divided form of alumina gel as above defined. Accordingly, such water-soluble aluminum organic compounds as aluminum isopropoxide and aluminum sec-butoxide can be dissolved in the primer slurry to provide comparable results in the dried primer material as can be obtained from dry mixing the preformed alumina gel with other solid constituents in the primer mixture. Addition of up to 2 weight percent alumina gel in the preferred primer compositions hereinafter described provides the desired modification in primer operation.

BRIEF DESCRIPTION OF THE DRAWING

The accompanying drawing is a cross-sectional view partly in elevation of a preferred high-voltage flashlamp of the present invention.

DESCRIPTION OF THE PREFERRED EMBODIMENTS

Figure 1:
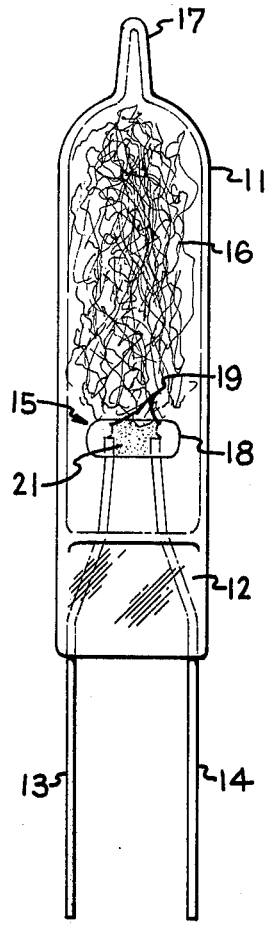

In a preferred flashlamp design of the present invention, a mount construction is employed for assembly of the inlead wires and primer material. Said flashlamp mount construction comprises a glass bead or other electrically-insulated member provided over an and of the pair of inlead wires. An opening is provided to the bead member between and in communication with both of the inlead wires, and primer material is provided in the opening and electrically bridges across the inlead wires. Preferably, the aforesaid opening extends fully through the bead member in a direction parallel to the inlead wires. Also, preferably, a portion of the bead member extends above and overlies at least a portion of the ends of the inlead wires. One of the inlead wires may extend through the top of the bead member for contact with the filamentary combustible material in the lamp. The underside of the bead member may be sleeved or shaped to provide increased electrical insulation between the inlead wires.

The above-described preferred lamp construction has the same general features described in U.S. Pat. No. 3,506,385 to Kurt Weber and George Cressman, which comprises a tubular envelope 11 preferably made of a borosilicate glass or other suitable light-transmitting vitreous material such as lead glass and having a stem press seal 12 at one end thereof through which a pair of inlead wires 13 and 14 extend from the exterior to the interior of the bulb 11 in a generally mutually parallel spaced apart manner and form part of a mount 15. The bulb 11 is partially filled, above the mount 15, with a loose mass of filamentary or shredded metal wire or foil 16, of zirconium or hafnium, or other suitable combustible metal. Air is exhausted from the bulb 11, and the bulb is filled with oxygen at a pressure of at least several atmospheres, such as about 5 to 10 atmospheres or greater, and the bulb is sealed off at an exhaust tip 17 at the other end thereof from the stem press seal 12. The lamp may be coated with the usual lacquer or plastic protective coating. The mount member 15 includes flash ignition means for igniting the combustible material 16 and comprises a glass bead or other vitreous electrically-insulative member 18 sealed over and around an end of the pair of lead-in or inlead wires 13 and 14. An opening 19 is provided to the bead 18 and is between and in communication with both of the inlead wires 13 and 14. The bead 18 may be formed by placing a ring of glass around the ends of the inlead wires and heating for a suitable time and a suitable temperature so as to cause the glass ring to shrink into molten contact with the end portions of the inlead wires, leaving a slot-like or other shaped opening 19. Greater accuracy can be achieved by molding the glass ring in place or into place. The ends of the inlead wires 13 and 14 extend only partially into the bead, as shown, and the bead material overlies the end of the inlead wires. The opening 19 is at least partially filled with a solid mixture of the primer material 21.

As previously indicated, a liquid coating composition of the primer material can be deposited in the opening 19 of the mount construction by various means such as with a syringe, or by daubing, or by dipping the inverted mount member in the liquid primer slurry. The small cross-sectional area of the opening 19 and the opening being open at both ends causes a capillary action effect which aids in drawing the liquid primer slurry into the opening. The binder and liquid medium are then dried out from the primer material 21 in the opening 19 and the coated mount 15 can thereafter be sealed in the envelope 11. The filamentary combustible material 16 is positioned in the envelope above the bead 18 whereby the upper end of the opening 19 is directed toward the combustible material 16, the tipped-off end 17 is necked down, the bulb is evacuated and filled with oxygen, and then tipped off at 17.

An illustrative aqueous primer coating composition made in accordance with the present invention can be obtained by first conventionally mixing 10 parts zirconium powder, 3 parts barium chromate, 1 part sodium chlorate, 0.2 parts polyvinyl pyrrolidone binder, and 4–10 parts water to produce an even blend of the constituents which is stable for storage over reasonably long time periods. Various amounts of the alumina gel additive can be dispersed in said primer composition with the effect of increasing the breakdown voltage characteristic of the dried primer material as shown in the table below:

| Alumina (Weight Percent) | Primer Weight (Milligrams) | Breakdown Voltage (Average) |
|---|---|---|
| 0 | .52 | 613 |
| 0.25 | .60 | 664 |
| 0.50 | — | 700 |
| 0.75 | .61 | 719 |

-continued

| Alumina (Weight Percent) | Primer Weight (Milligrams) | Breakdown Voltage (Average) |
|---|---|---|
| 1.0 | — | 842 |
| 1.5 | 0.74 | 907 |

It can be noted from the above table that increased alumina gel concentration in the primer mixture raises the breakdown voltage level approximately 200 volts for each one weight percent addition of the additive.

An especially preferred primer material composition of the present invention contains a mixture of $Co_3O_4$ and $BaCrO_4$ as the combustion-supporting oxide constituent to provide a primer that is both sufficiently ignition sensitive and does not result in forming a conductive residue after ignition. This primer material composition can be obtained starting with a solid premixture in percentages by weight 46.1% zirconium, 14.5% sodium chlorate, 31.7% $Co_3O_4$, and 7.7% $BaCrO_4$ which further contains between 1–5% of a water-soluble polymer binder such as polyvinyl alcohol or polyvinyl pyrrolidone. To said premixture can be mixed from approximately 0.25–2.0 weight percent of the alumina gel additive and the final solid mixture thereafter dispersed in a suitable liquid medium for flashlamp manufacture in the manner above described.

The desired effect of the alumina gel additive upon primer reliability can be demonstrated by the following comparison. The above preferred primer composition, but without the alumina additive, produced lamps with a primer failure rate of 0.3% when flashed by using a piezoelectric generator capable of producing a maximum output energy of 40 microJoules. The preferred primer with 1.5 weight percent alumina additive produced lamps with a failure rate of 0.1% when flashed with a piezoelectric generator with an identical output. In addition, the incorporation of the alumina gel to the primer which increased primer reliability did not change the primer sensitivity to spurious flashouts by stray electrostatic pulses.

While the best mode of carrying out the present invention has been set forth above, it will be understood that additions, changes and modifications may be made thereto without departing from the spirit and scope of the invention as defined in the appended claims. For example, it will be apparent that the primer can be made more or less sensitive to ignition in air or oxygen and that the breakdown voltage can be further altered. Also, the liquid primer composition can be varied to make the composition safer to handle wet or dry and still be made sensitive enough to reliably ignite the flashlamp upon application of the high-voltage pulse. Consequently, the proper balance between safety and sensitivity will specify the particular formulation best filled for a particular lamp application. It is intended to limit the present invention, therefore, only to the scope of the following claims.

What I claim as new and desire to secure by Letters Patent of the United States is:

1. A primer material for a high-voltage activated flashlamp which comprises a solid mixture of a combustible fuel, an oxidizer for said combustible fuel, a combustion-supporting oxide which is converted to a lower oxide upon combustion of the mixture and a small but effective amount of an alumina gel additive.

2. A primer material as in claim 1 wherein the combustion-supporting oxide is present in sufficient amounts to lower the electrical conductivity of the primer residue.

3. A primer material as in claim 1 wherein the alumina gel additive is present in an amount from about 0.25–2.0 weight percent of the solid mixture.

4. A primer material as in claim 1 wherein the combustible fuel is a powdered combustible incandescible metal.

5. A primer composition as in claim 4 wherein the powdered combustible incandescible metal is zirconium.

6. A primer material as in claim 5 wherein the oxidizer includes an alkali or alkali metal chlorate compound.

7. A primer material as in claim 5 wherein the combustion-supporting oxide is selected from the group consisting of $Co_3O_4$, $BaCrO_4$, $Fe_2O_3$, and higher oxides of nickel.

8. A primer material as in claim 7 wherein the combustion-supporting oxide comprises a mixture of $Co_3O_4$ and $BaCrO_4$.

9. A primer coating composition which comprises an aqueous dispersion of a water-soluble polymer binder having an oxidizer dissolved therein and a powdered mixture of combustible incandescible metal, a combustion-supporting oxide, and an alumina gel additive.

10. A high-voltage activated flashlamp comprising a hermetically sealed light-transmitting envelope, a quantity of filamentary combustible material distributed within said envelope, and flash ignition means within said envelope which includes a pair of spaced apart inleads having a mass of primer material connected between said inleads, wherein the primer material comprises a solid mixture of a combustible fuel, an oxidizer for said combustible fuel, a combustion-supporting oxide which is converted to a lower oxide upon combustion of the mixture, and an alumina gel additive.

11. A high-voltage activated flashlamp as in claim 10 wherein the inleads are spaced apart with an electrically-insulative member.

12. A high-voltage activated flashlamp as in claim 11 wherein the electrically-insulative member is disposed over an end of the pair of inlead wires and contains an opening in communication with both of said inlead wires containing a primer material.

13. A high-voltage activated flashlamp as in claim 12 wherein the opening extends fully through the electrically-insulative member in the direction parallel to the inlead wires.

14. A high-voltage activated flashlamp as in claim 13 wherein the electrically-insulative member extends above and overlies at least a portion of the ends of the inlead wires.

* * * * *